US005622284A

United States Patent [19]

Sawicki

[11] Patent Number: 5,622,284

[45] Date of Patent: Apr. 22, 1997

[54] CHILD-RESISTANT, TOGGLE-ACTION CLOSURE

[76] Inventor: Craig Sawicki, 1469 Haise, Elk Grove Village, Ill. 60007

[21] Appl. No.: 627,990

[22] Filed: Apr. 8, 1996

[51] Int. Cl.[6] ..... B65D 47/08; B65D 55/02; B67D 5/32

[52] U.S. Cl. ..... 222/153.14; 222/182; 222/536

[58] Field of Search ..... 222/153.03, 153.14, 222/182, 534, 536

[56] References Cited

U.S. PATENT DOCUMENTS

| | | | |
|---|---|---|---|
| 3,542,256 | 11/1970 | Waterman | 222/534 X |
| 4,135,638 | 1/1979 | Wandl | 222/182 X |
| 4,763,801 | 8/1988 | Nycz | 222/534 X |
| 4,887,747 | 12/1989 | Ostrowsky et al. | 222/536 X |
| 4,962,869 | 10/1990 | Gross et al. | 222/153.14 |
| 5,092,493 | 3/1992 | Pehr | 222/153.03 X |
| 5,236,107 | 8/1993 | Spaanstra, Sr. | 222/536 X |
| 5,284,264 | 2/1994 | Gross | 222/534 X |
| 5,314,093 | 5/1994 | Gross et al. | 222/153.14 |

FOREIGN PATENT DOCUMENTS

| | | | |
|---|---|---|---|
| 558810 | 9/1993 | European Pat. Off. | 222/536 |
| 2231036 | 11/1990 | United Kingdom | 222/536 |
| 94022733 | 10/1994 | WIPO | 222/536 |

*Primary Examiner*—Kevin P. Shaver
*Attorney, Agent, or Firm*—Michael G. Berkman

[57] ABSTRACT

There is provided, in conjunction with a container fitted with a toggle-acting dispensing closure cap, a cap-surmounting secondary control cap to render the container "child-resistant". The control cap is sleeved over and is coaxial with and rotatable about the closure cap. Bridging a generally-cylindrical skirt-like wall of the control cap is a partial, sector-like top wall which covers only a portion of the closure cap including the toggle-like actuator used to open and to close a dispensing port of the container. The partial top wall, which is provided with a restricted through opening, prevents one from impressing effective opening forces on a "press-to-open" section of the actuator. Opening forces can be applied to the actuator only by a probe acting through the restricted opening in the top wall sector of the control cap, and then only when that wall sector overlies the press-to-open section of the actuator.

5 Claims, 1 Drawing Sheet

CHILD-RESISTANT, TOGGLE-ACTION CLOSURE

FIELD AND BACKGROUND OF THE INVENTION

The present invention relates to a toggle-action closure for a container, mounted on a neck thereof. More particularly, the invention is directed to a "child-resistant" closure device of the toggle type, and which is simple in structure and exceedingly reliable in use.

Many "child-proof" closures for many types of containers are known in the art. Such structures have taken innumerable forms and varied mechanical configurations. Some of the closures have been used in conjunction with dispensers having "toggle-action" controls for regulating the dispensing of fluids from containers. It is in combination with this type of closure that the present invention finds utility. The invention itself is characterized by enhanced reliability and simplicity.

SUMMARY OF THE INVENTION

It is an important feature of the present invention that it provides a container closure so constructed as to make delivery of the contents of the container by small children exceedingly difficult and highly unlikely, but which poses no problems for adults.

A related feature of the invention is that the object of rendering the closure "child-resistant" is achieved without critical modification of the toggle-structure of the pivotal closure or actuator.

Yet another important feature of the invention is that it requires no significant modification of the container in which it is incorporated. and requires no modification of the neck of the container.

The present invention finds utility in valve closures of the type which include a pivotally-mounted actuator shiftable between a configuration in which a product delivery port is open to allow the dispensing of material from the container, and a configuration in which the actuator pivots or toggles to effect a positive obstruction of or closure of the product delivery port.

In a preferred embodiment of the invention the actuator is pivotally supported on a shaft or hinge-like pin secure or trunnioned in a wall bounding the toggle assembly.

In one specific embodiment of the invention the pivotal actuator is formed on an under surface thereof with a plug for sealingly invading or penetrating a product discharge port which itself communicates with an interior of the container, the port extending through a base wall of the closure cap, A related feature of the toggle closure of the invention is that the pivotal actuator is formed in a depending, skirt-like wall thereof with a laterally-extending duct open at each of its opposed ends and communicating with the product discharge port only when the pivotal actuator is hingedly angled to assume a product-dispensing configuration or attitude.

It is a very important feature of the child-resistant assembly of the invention that there is provided a secondary cover or control cap which is secured to the neck structure of the container and overlies the toggle-acting pivotal actuator.

A critical feature of the control cap of the invention is that it includes a top or cover component which covers less than the full top area of the assembly, and which is preferably limited to define a sector constituting about half of the top areal expanse of the closure cap or dispenser cap.

It is a critical feature of the invention that when the "half-top" cover sector of the control cap assumes a configuration in which the sector is remote from the "press" zone of the valve and overlies that sector of the actuator that must normally tilt upwardly when one impresses a force on the "press-to-open" portion of the valve, the half-top sector constitutes a physical stop or impediment which prevents the actuator from pivoting. Accordingly, the valve remains secured in a closed configuration.

When the control cap is rotated to bring the half-top cover to a diametrically opposite location, the cover overlies the "press" or "press-to-open" zone of the valve actuator. Again, digitally-applied pressure is again ineffective to pivot the actuator and to open the valve.

An exceedingly significant feature of the invention is that the partial, half-top wall of the control cap is formed with a small, through, access hole. When the wall sector is oriented to overlie the "press" zone of the pivotal actuator, that zone is accessible through the hole, using a probe such as a pencil. In this mode, pressure applied by the probe is effective to tilt the actuator to a valve-open configuration. It is only in this manner that the dispensing valve can be opened.

In a preferred embodiment of the invention the closure cap is formed with a chimney open at the top and communicating at its base, through the neck of the container, with the interior of the container itself. It is through this chimney that the contents of the container are dischargeable when the pivotal actuator is in an angled, open disposition, and the top of the chimney is uncapped and open.

In the embodiment of the invention illustrated, the closure cap which houses the pivotal valve-controlling actuator is threadedly attached to the threaded neck of the container, and a control cap formed with a generally-cylindrical bounding wall, is sleeved over the closure cap of the assembly.

It is a related feature of the invention that the control cap is formed at a lower extremity of its cylindrical, depending, skirt-like wall with a radially-inwardly-directed bead, flange or rib which engagingly locks below a lower edge of the neck-encircling body of the closure cap to prevent inadvertent separation or dislodgement of the control cap from the assembly.

In the specific embodiment of the invention illustrated, the pivotally-mounted actuator is formed with a passage opening laterally through a bounding cylindrical wall thereof. When the actuator is in a horizontal disposition,the passage is blocked by the upstanding chimney which communicates with the interior of the container. In the tilted or "open" mode of the actuator the exit port of the chimney communicates with the passage in the actuator to permit delivery of material from the container for use.

Other and further advantages, features and objects of the invention will be evident upon a reading of the following specifications and upon consideration of the drawings.

DETAILED DESCRIPTION OF ILLUSTRATED EMBODIMENT

Figure 1:
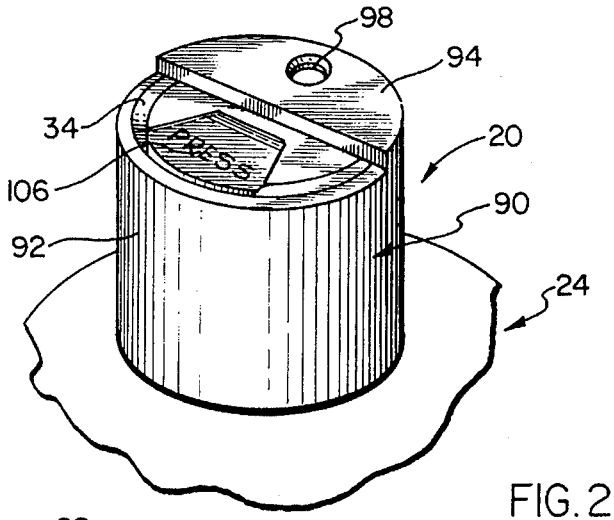
FIG. 1 is a perspective, fragmentary view of a container top showing a neck-mounted closure according to the present invention, and in a mode to deter the opening of the product discharge port.

In accordance with the present invention, the aims and objects are achieved by providing, in conjunction with a toggle-action closure cap for a container, an auxiliary control cap. The control cap overlies the closure cap, which is itself attached to and carried on the neck of the container. The control cap, which is rotatable with respect to the closure cap, includes a sector-like partial top wall or baffle which, at any given instant, overlies a particular end portion or end zone of a toggle-acting valve actuator constituting a functional part of the closure cap.

In the conventional arrangement, in prior art structures, the actuator is readily accessible, without physical impediment, at all times, and is always selectably pivotal between a closed position and an open position of the valve. The toggle-acting valve is ordinarily opened by impressing a digitally-applied force to a "press-to-open" zone of the pivotally-supported actuator. The present invention precludes such unrestricted actuation.

When the partial top wall of the control cap of the invention overlies that end zone of the pivotal actuator remote from the "Press" zone, pivotal toggle action or displacement of the actuator is mechanically precluded. It is prevented, physically. When the partial top wall is rotated 180° to overlie the "Press" zone of the normally pivotal actuator, the baffle-like top wall sector effectively shields the "Press" zone or the "press-to-open" zone of the actuator mechanically. The application of effective digital pressure to open the valve is prevented, physically. Again, the actuator cannot be "toggled" to an open configuration of the valve.

It is an important feature of the invention that the partial top wall or baffle of the control cap is formed with a small hole through which a probe-like element such as a pencil point or a ball point pen may be inserted to gain access to and to "depress", and thus open the toggle-like valve. This is possible only when the baffle sector overlies the "press-to-open" end zone of the pivotal, toggle-acting actuator.

Referring more particularly to the drawings, for purposes of disclosure, and not in any limiting sense, one particular embodiment of the "child-resistant" valve assembly 20 of the invention, incorporating the features thereof, is shown as surmounting a container 24 having a neck 26 formed with outer threads 28. A closure cap 30 having a cylindrical wall 34 formed with interior threads 38 is secured to the neck 26 of the container 24.

Figure 4:
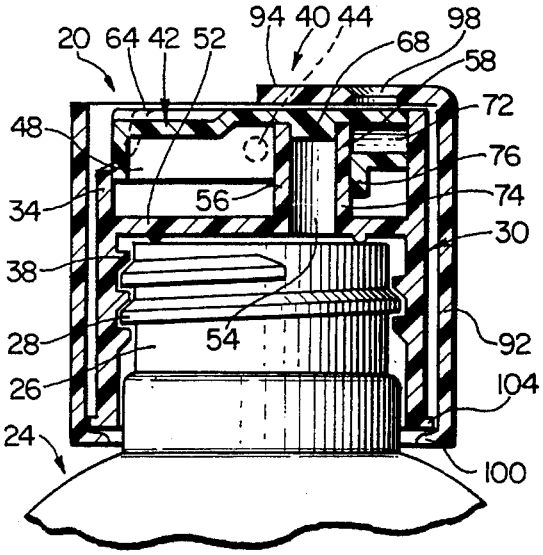
FIG. 4 is a cross-sectional view taken substantially on the lines 4—4 of FIG. 2, and showing the dispenser in a closed configuration.
Figure 5:
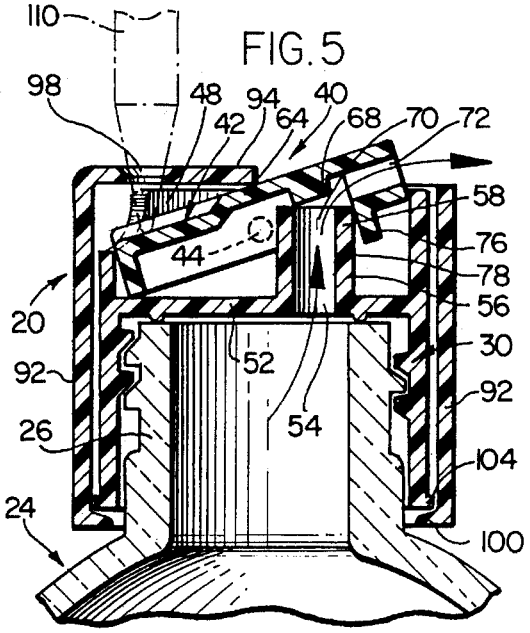
FIG. 5 is a cross-sectional view taken substantially on the lines 5—5 of FIG. 3, and indicating,schematically, the manner in which the actuator is displaced pivotally to establish a product-dispensing configuration of the assembly.

As shown in FIGS. 1, 4 and 5, the particular embodiment of the invention illustrated includes a valve assembly 40 which includes a toggle-acting actuator 42. The actuator 42 is physically supported on a horizontally-extending shaft or pin 44 the opposite ends of which are seated or journalled in a ring-like body component or sidewall 48 of the valve assembly 40. The valve assembly 40 includes a horizontal base or floor 52 formed with a through port 54 surmounted by a chimney 56 having an open port 70 at the top 58 of the chimney 56. The port 54 at the base 60 of the chimney 56 communicates with the interior of the container 24, as shown in FIGS. 4 and 5, schematically.

With the actuator 42 in an open mode of the valve, as depicted in FIG. 5, the product dispensed exits from the top of the chimney 56, at port 70, and is finally forcibly discharged from the exit passage 72 formed in the actuator 42. In a zone adjacent the chimney wall 74, the wall 48 of the actuator 42 is formed with a stub-like, downwardly-extending projection 76 for abutting the wall 78 of the chimney 56 when the valve is in a closed configuration, as shown in FIG. 4.

Figure 3:
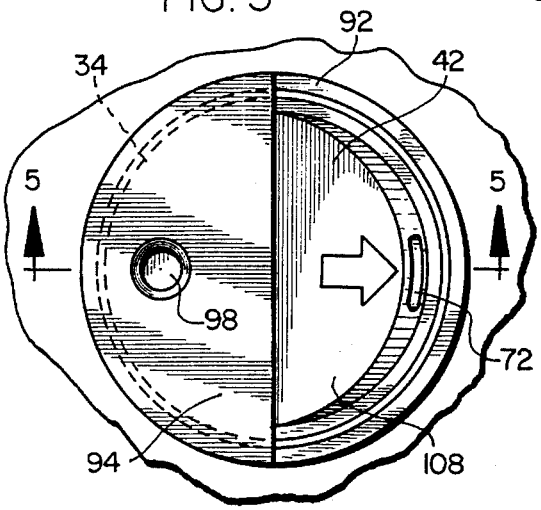
FIG. 3 is a top plan view of the assembly of FIG. 1, but with the control top of the invention rotated 180° and with the actuator toggled to establish a product-dispensing mode of the assembly.
Figure 2:
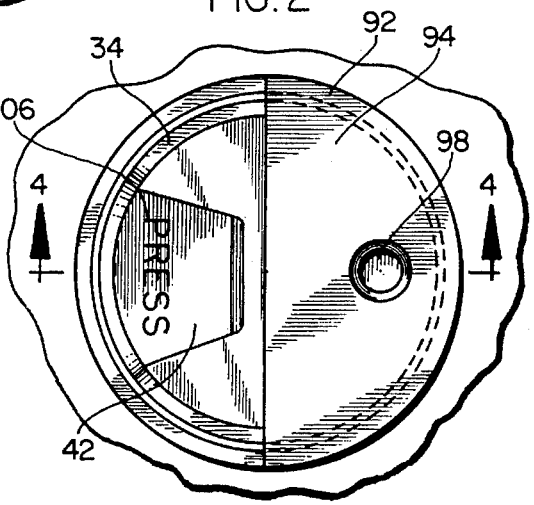
FIG. 2 is a top plan view of the assembly of FIG. 1.

Sleevedly disposed to encircle and to overlie the closure cap 30, there is provided, in accordance with the present invention, a control cap 90. As shown in FIGS. 1–3, the control cap 90 includes a generally-cylindrical, upright wall 92 surmounted with a partial top wall 94 which is generally hemispherical in form and covers essentially half of the areal expanse encompassed by the cylindrical wall 92. The half-wall 94 is formed with a small, through opening 98.

The control cap 90, which is sleevedly telescoped over the closure cap 30, is retained in place by a radially inwardly directed annular bead or ring 100, at the base of the cylindrical wall 92. The bead 100 seats beneath a bottom perimetric edge 104 of the sidewall 34 of the closure cap 30, as shown in FIGS. 4 and 5.

The manner in which the control cap 90 of the invention renders the dispensing valve "child-resistant" is described with reference to FIGS. 2 through 5. Referring first to FIGS. 2 and 4, the "PRESS" to open zone 106 of the actuator 42 is exposed and accessible. However, since the half-circle sector 94 or top wall of the control cap 90 snuggly overlies the portion of the actuator 42 remote from the "PRESS" to-open zone 106, the overlying top wall 94 prevents the actuator 42 therebeneath from pivoting (see FIG. 4) upwardly as it must (see FIG. 5), if the valve is to assume a configuration in which the product can be dispensed through the conduit path from the container 24, through the port 54, out of the chimney vent 70, and finally from the delivery passage 72 formed in the pivotal actuator 42 itself (FIG. 5) in that section 108 of the actuator 42 remote from the "PRESS" section 106.

With the semi-circular top wall 94 of the control cap 90 rotated 180° to overlie and cover the "PRESS" zone 106, as shown in FIG. 3, digital pressure cannot be applied on the "PRESS" to-open sector 106 of the actuator 42. Accordingly, any such applied pressure will be ineffective to open the valving system. No product will be discharged from the container 24.

A critical feature of the invention is that the actuator-shielding top wall 94 of the control cap 90 is formed with a restricted through hole 98 (FIGS. 3 and 5) through which the end of a pencil or of a ball-point pen 110 may be inserted to depress the "PRESS" zone 106 of the actuator 42. Pressure thus applied, through the restricted access opening 98 will be effective to open the valving system so that product stored in the container may be conveniently and safely dispensed.

What is claimed is:

1. A container having a neck and a toggle-action dispensing cap, means for securing said dispensing cap on said neck of said container, said dispensing cap having a top wall formed with a product-dispensing through port communicating with an interior chamber of said container, a pivotally-supported, toggle-acting actuator overlying said dispensing cap and defining a closure for said port of said dispensing cap, said actuator having a "press-to-open" section, plug means carried by said actuator at an undersurface thereof for closing said port, means pivotally supporting said actuator for pivotal movement selectively between a first position in which said plug means is disposed to seal said port in said dispensing cap, and a second position in which said port is not obstructed by said plug means and is exposed for delivery therethrough of material stored in and to be dispensed from said container, an outer control cap coaxial with and sleevedly overlying said dispensing cap and rotatable axially with respect thereto, said control cap including a generally-cylindrical, skirt-like sleeve encircling said dispensing cap and said neck of said container, means lockingly securing said control cap against axial displacement with respect to said dispensing cap, panel means defining a sector-like partial top wall bridgedly surmounting and normal to said skirt-like sleeve of said control cap and leaving a portion of said actuator exposed, said panel means being formed with a restricted through opening for physically accessing said actuator therethrough, said panel means constituting stop means to prevent downward physical displacement of said press-to-open section of said actuator when said section is visually exposed, said actuator being pivotal to establish an open position of said product dispensing port only when said panel of said control cap is rotated to overlie the depressible "press-to-open" portion of said actuator, and said press-to-open portion being then accessible only by means of a probe insertable through said opening in said sector-like panel to depress said press-to-open section and to effect a pivotally-open mode of said actuator.

2. A container as set forth in claim 1 and wherein said means for securing said dispensing cap on said container comprises outer threads integrally formed on said neck of said container, and interior threads formed on said dispensing cap.

3. A container as set forth in claim 1 wherein said dispensing cap includes a depending wall encircling said neck of said container and coupled thereto, said encircling wall terminating at a lower end thereof in an annular edge spaced radially outwardly of said neck of said container, and wherein said skirt-like sleeve of said control cap is formed at a lower annular extremity thereof with a neck-encircling, radially-inwardly-projecting rib disposed below said annular edge of said dispensing cap, said rib constituting said means lockingly securing said control cap.

4. A container as et forth in claim 1 and further comprising a cylindrical body of said dispensing cap depending from said top wall thereof, an annular flange integrally formed with, depending from, and encircling said actuator, pivot pin means extending horizontally through said flange of said actuator and seated at each opposed ends of said pin means in said cylindrical body of said dispensing cap for supporting said actuator for selective pivotal displacement between open and closed dispositions of said product-dispensing port.

5. In a container having a neck and a toggle-action dispensing cap, and including means for securing said dispensing cap on said neck of said container, said dispensing cap having a top wall formed with a product-dispensing through port communicating with an interior chamber of said container, a pivotally-supported,toggle-acting actuator overlying said dispensing cap and defining a closure for said port of said dispensing cap, said actuator having a press-to-open section, plug means carried by said actuator at an undersurface thereof for closing said port, means pivotally supporting said actuator for pivotal movement selectively between a first position in which said plug means is disposed to seal said port in said dispensing cap, and a second position in which said port is unobstructed by said plug means and is exposed for delivery therethrough of material stored in and to be dispensed from said container, the improvement comprising an outer control cap coaxial with and sleevedly overlying said dispensing cap and rotatable axially with respect thereto, said control cap including a generally-cylindrical, skirt-like sleeve encircling said dispensing cap and said neck of said container, means lockingly securing said control cap against axial displacement with respect to said dispensing cap, panel means defining a sector-like partial top wall bridgedly surmounting and normal to said skirt-like sleeve of said control cap and leaving a portion of said actuator exposed, said panel means being formed with a restricted through opening for physically accessing said actuator therethrough, said panel means constituting stop means to prevent downward physical displacement of said press-to-open section of said actuator when said section is visually exposed, said actuator being pivotal to establish an open position of said product dispensing port only when said panel of said control cap is rotated to overlie the depressible "press-to-open" portion of said actuator, and said press-to-open portion being then accessible only by means of a probe insertable through said opening in said sector-like panel to depress said press-to-open section and to effect a pivotally-open mode of said actuator.

* * * * *